US006923666B1

(12) United States Patent
Liao

(10) Patent No.: US 6,923,666 B1
(45) Date of Patent: Aug. 2, 2005

(54) ELECTRICAL PLUG CHANGER

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/774,480

(22) Filed: Feb. 10, 2004

(30) Foreign Application Priority Data

Jan. 9, 2004 (TW) ..... 93200433 U

(51) Int. Cl.[7] ..... H01R 29/00
(52) U.S. Cl. ..... 439/172; 439/171; 439/173; 439/131
(58) Field of Search ..... 439/166–174, 439/131, 31; 363/146

(56) References Cited

U.S. PATENT DOCUMENTS 2,163,201 A * 6/1939 Kalencik ..... 439/172
3,025,486 A * 3/1962 Falconer ..... 439/103
4,518,212 A * 5/1985 Rumble ..... 439/166
4,543,624 A * 9/1985 Rumble ..... 363/146
4,626,052 A * 12/1986 Rumble ..... 439/173
5,159,545 A * 10/1992 Lee ..... 363/146
5,423,690 A * 6/1995 Selker et al. ..... 439/172
6,109,977 A * 8/2000 Baxter et al. ..... 439/693
6,233,167 B1 * 5/2001 Chen et al. ..... 363/146
6,250,939 B1 * 6/2001 Chou ..... 439/172
6,302,717 B1 * 10/2001 Cheung ..... 439/172
6,382,996 B1 * 5/2002 Eyman ..... 439/172
6,402,546 B1 * 6/2002 Groves et al. ..... 439/501

* cited by examiner

*Primary Examiner*—Tho D. Ta
*Assistant Examiner*—Larisa Tsukerman
(74) *Attorney, Agent, or Firm*—Rosenberg, Klein & Lee

(57) ABSTRACT

An electrical plug changer is described and has a housing, a first electrical plug, a second electrical plug, a linking mechanism and a clamping mechanism. The first electrical plug and the second electrical plug are slidably positioned within the housing. The linking mechanism is positioned between the first electrical plug and the second electrical plug so that there is relative movement between them. And, the clamping mechanism is connected to and is used to clamp the first electrical plug or the second electrical plug when the electrical plugs protrude.

9 Claims, 11 Drawing Sheets

ELECTRICAL PLUG CHANGER

BACKGROUND OF THE INVENTION

1. Field of the Invention

The present invention relates to an electrical plug changer, and in particular to an electrical plug changer which adapts to different outlets.

2. Description of Related Art

Presently, there are quite a few electrical plug changers on the market. Electrical plugs of the electrical plug changers are made in the US, Great Britain, Europe, China or Taiwan. Users can choose the appropriate electrical plug for insertion into an electrical outlet. Such electrical plug changers have a plurality of electrical plugs so that it is not necessary for users to buy different kinds of electrical plugs.

However, when the user would like to change one kind of electrical plug to another in the prior art, it is necessary for the user to protrude the desired kind of electrical plug within the electrical plug changer after he retracts the previous kind of electrical plug. The transition from one kind of electrical plug to another requires two separate steps. It is inconvenient for users to use the conventional electrical plug changer.

Thus, there is need to develop an electrical plug changer.

SUMMARY OF THE DISCLOSURE

It is an object of the present invention to provide an electrical plug changer.

In order to accomplish the object of the present invention, the present invention provides an electrical plug changer. The electrical plug changer includes a housing, a first electrical plug, a second electrical plug, a linking mechanism and a clamping mechanism. The first electrical plug is slidably positioned within the housing, and the second electrical plug is slidably positioned within the housing. The linking mechanism is positioned between the first electrical plug and the second electrical plug so that there is relative movement between them. Further, the clamping mechanism is connected to and is used to clamp the first electrical plug or the second electrical plug when the electrical plugs protrude.

BRIEF DESCRIPTION OF DRAWINGS

The present invention can be fully understood from the following detailed description and preferred embodiment with reference to the accompanying drawings in which.

DETAILED DESCRIPTION OF THE PREFERRED EMBODIMENTS

Figure 2:
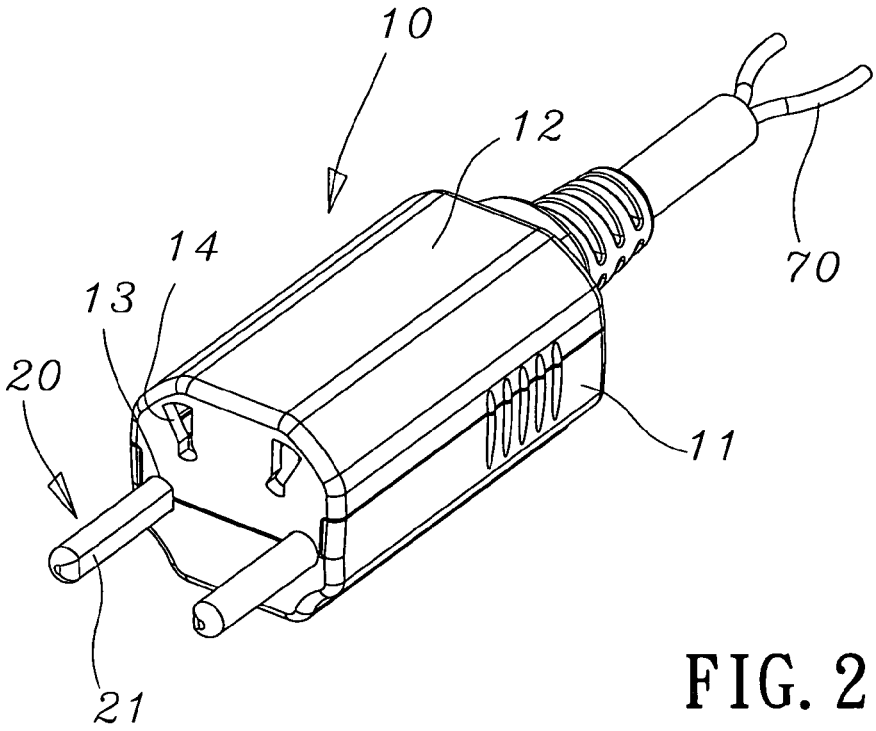
FIG. 2 is another perspective view of the electrical plug changer in accordance with the first embodiment of the present invention.
Figure 1:
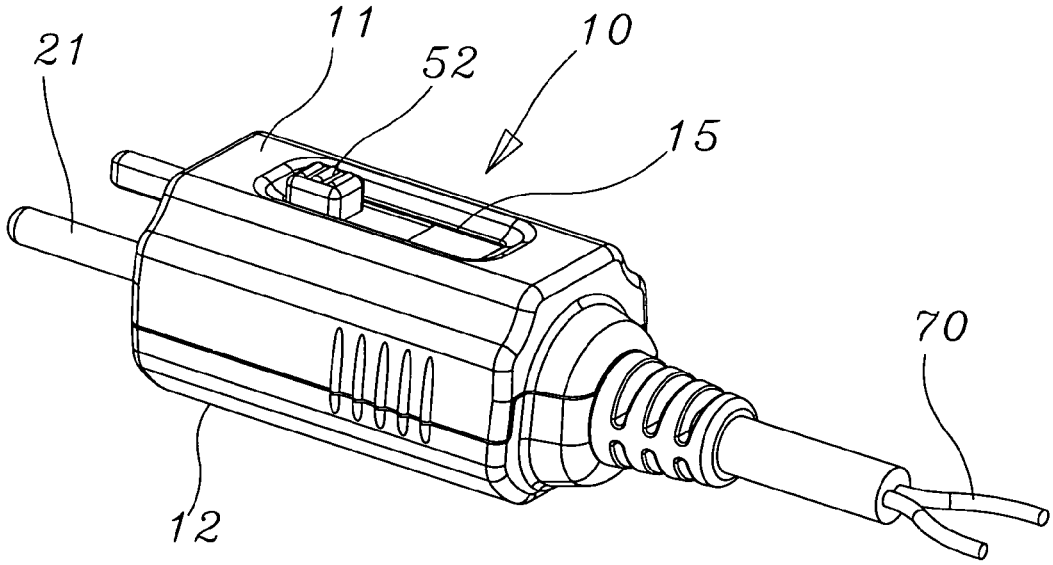
FIG. 1 is a perspective view of the electrical plug changer in accordance with the first embodiment of the present invention.
Figure 3:
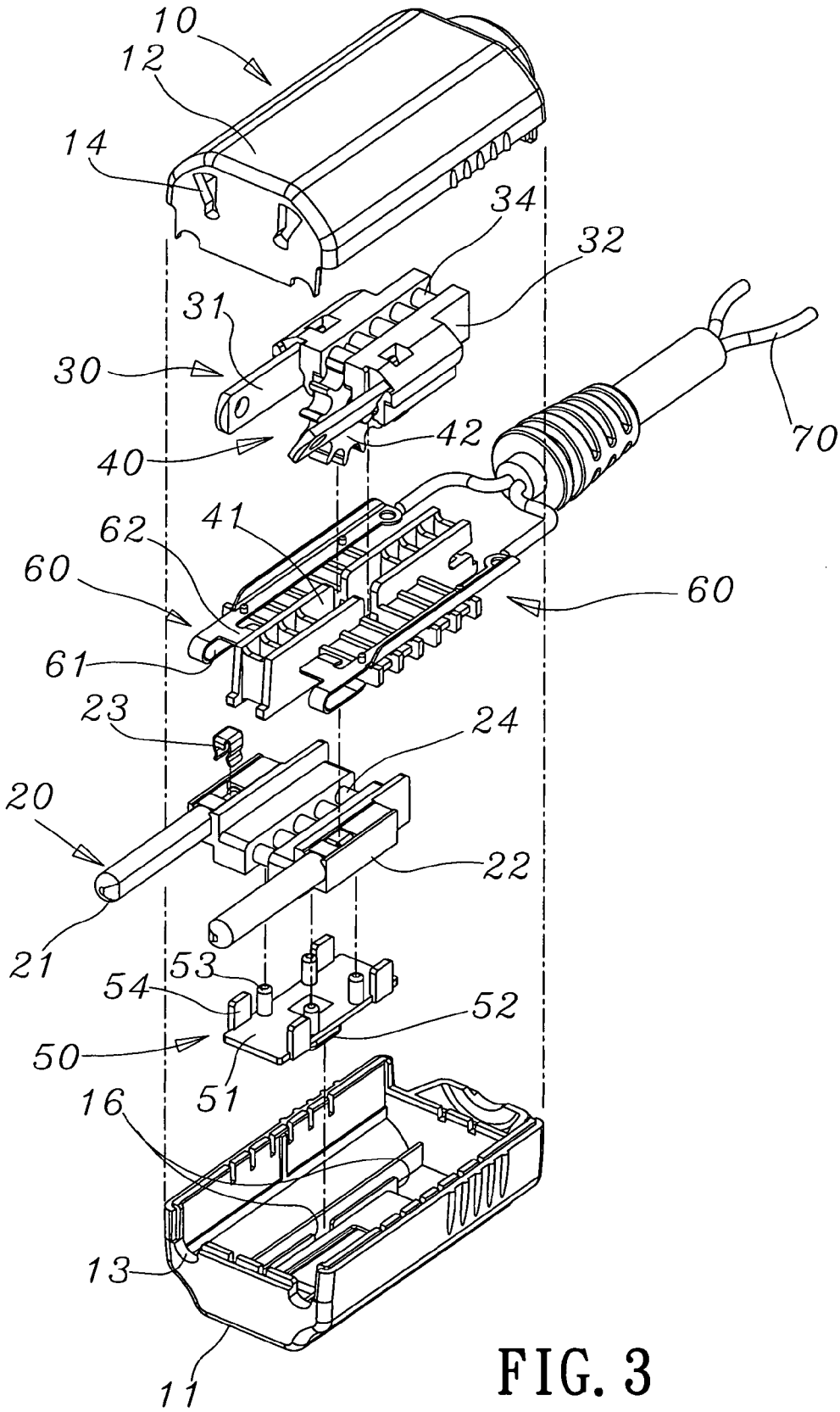
FIG. 3 is an exploded view of the electrical plug changer of FIG. 2.
Figures 4, 4A:
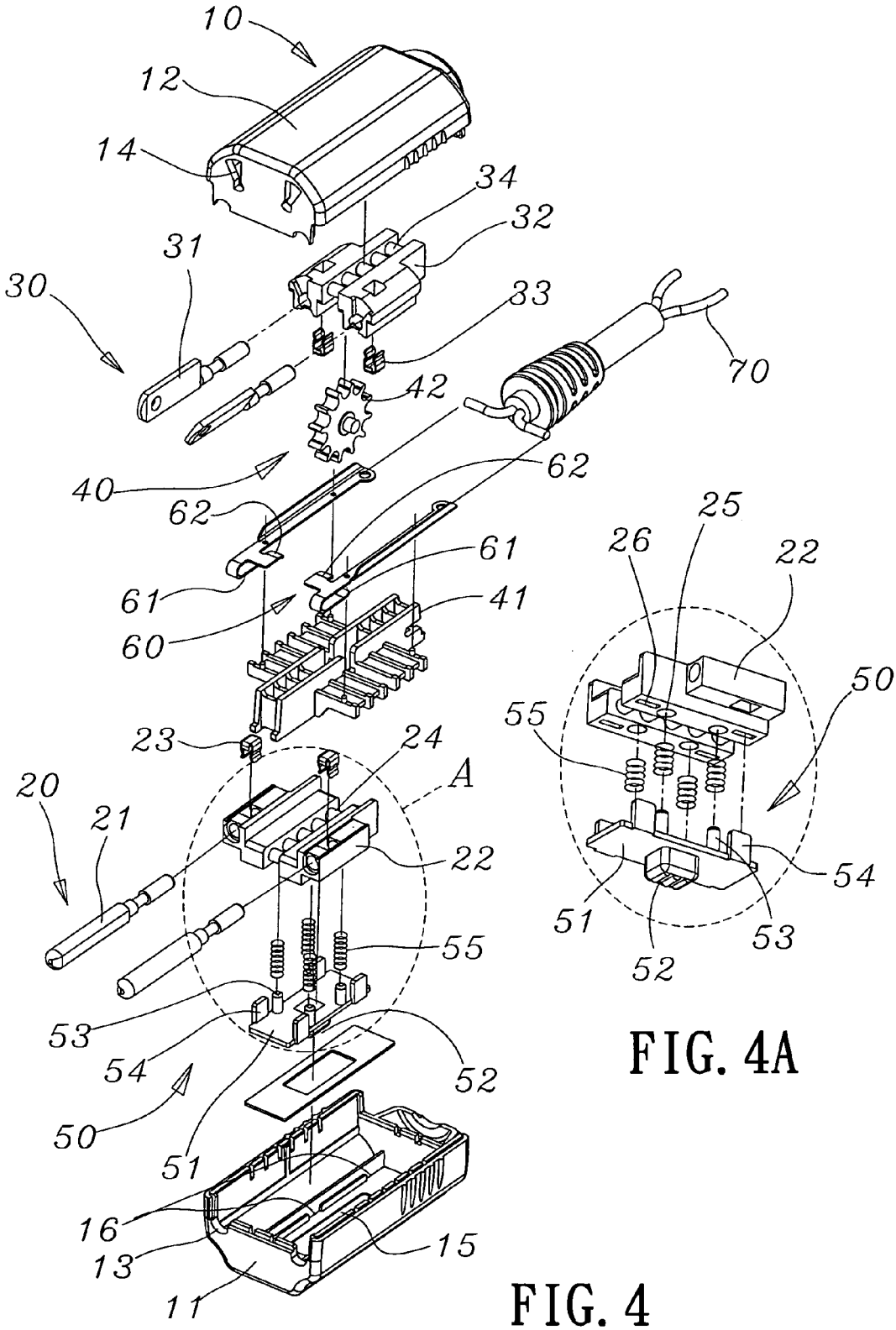
FIG. 4 is another exploded view of the electrical plug changer of FIG. 2.
FIG. 4A is a partial exploded view of the electrical plug changer of FIG. 2.
Figure 6:
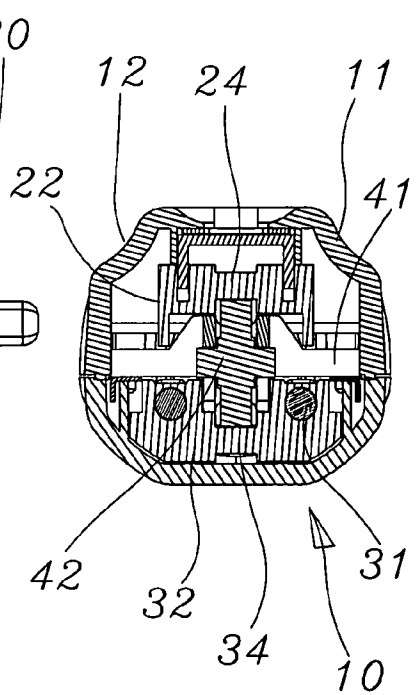
FIG. 6 is a cross-sectional view of the electrical plug changer of the present invention taken along the line 6—6.
Figure 5:
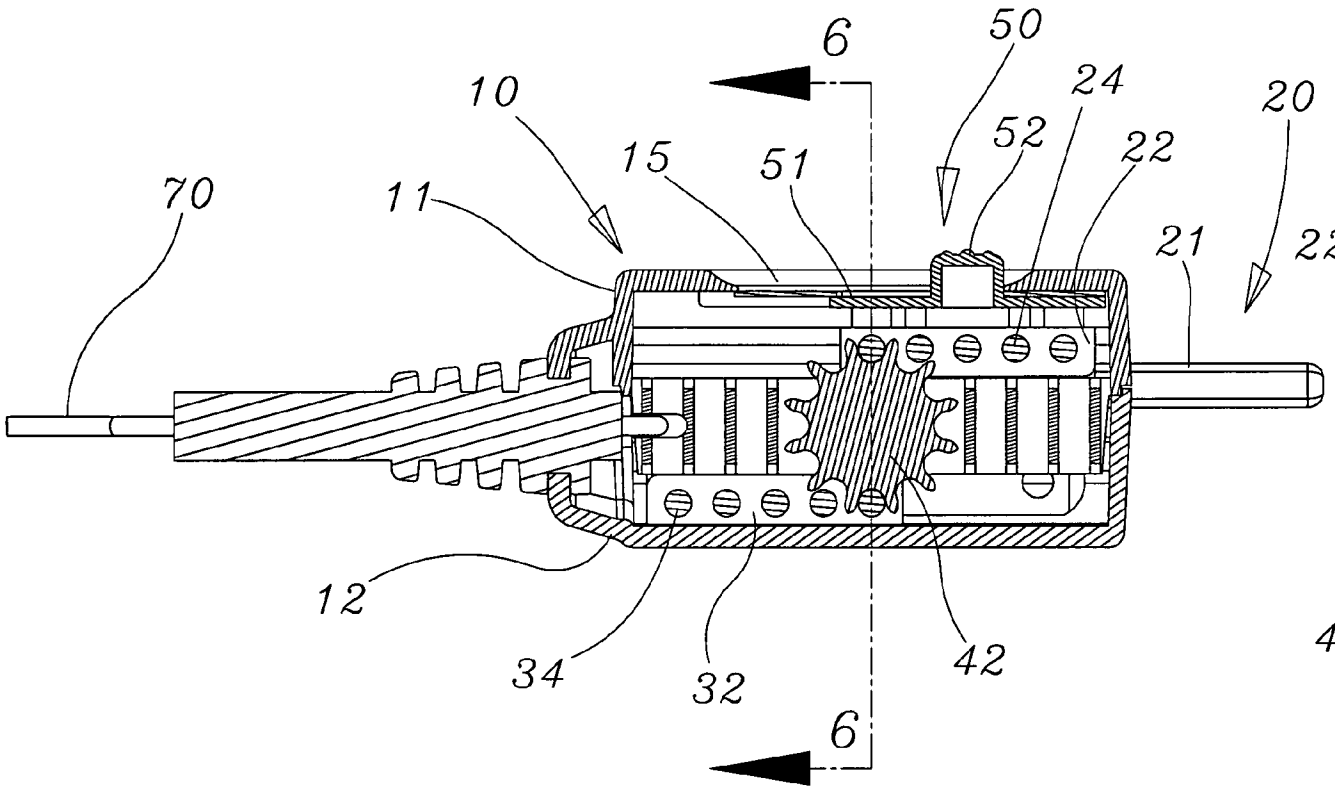
FIG. 5 is a cross-sectional view of the electrical plug changer of the present invention.
Figure 7:
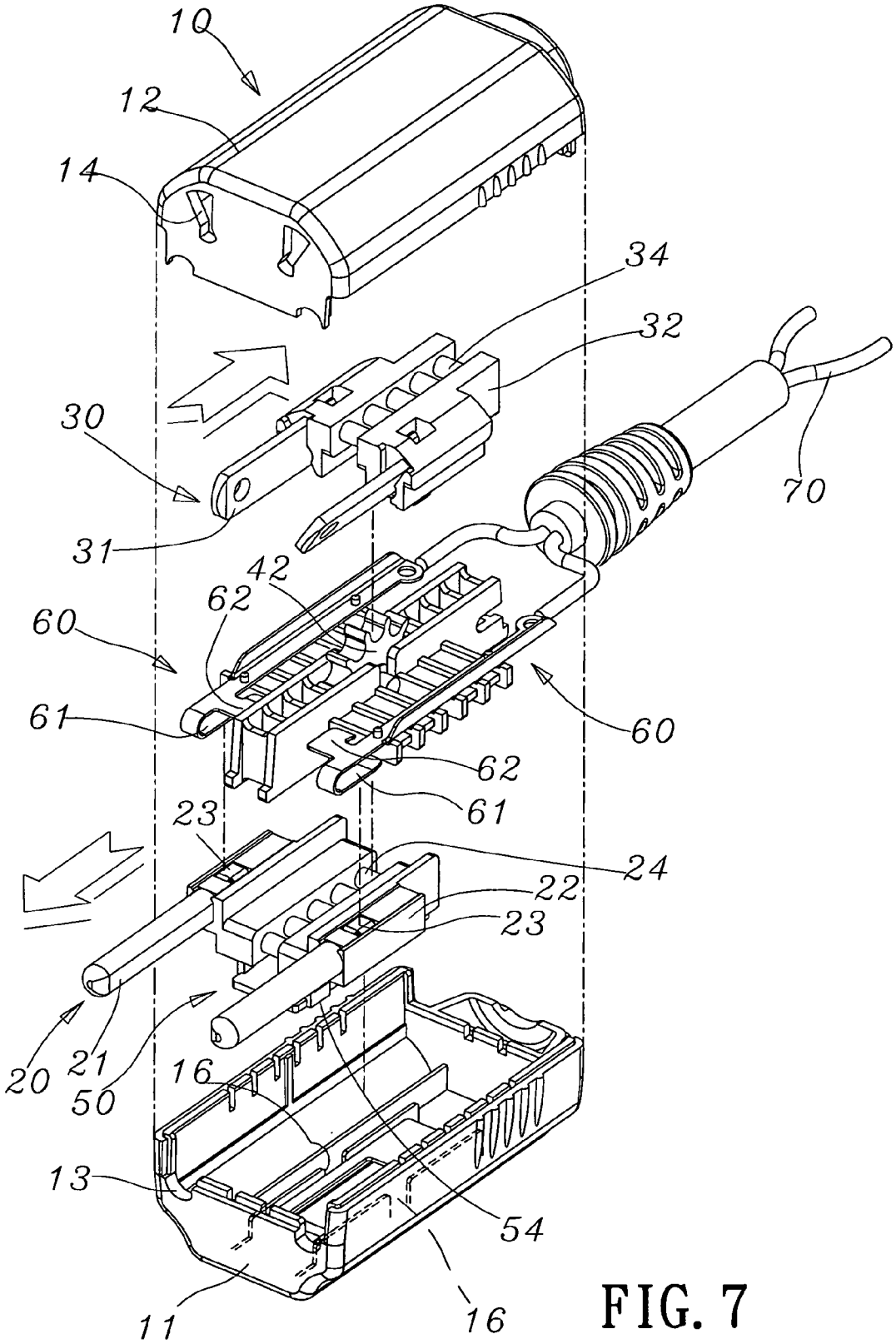
FIG. 7 is another top plan view of a wafer grinder of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Referring to FIGS. 1–6, the present invention provides an electrical plug changer. The electrical plug changer includes a housing 10, a first electrical plug 20, a second electrical plug 30, a linking mechanism 40, a clamping mechanism 50 and a pair of conductive members 60. The housing 10 is made of plastic, and a first cover 11 and a second cover 12 are connected by screwing or snapping so that the housing 10 is hollow. The housing 10 is used to receive the first electrical plug 20, the second electrical plug 30, the linking mechanism 40, the clamping mechanism 50 and the pair of conductive members 60. First holes 13 and second holes 14 are provided in the front surface of the housing 10 respectively, and a guide groove 15 is positioned in the top surface of the housing 10.

The first electrical plug 20 includes two first pins 21 which are made of conductive material and are inserted into a first mounting frame 22. Two first conductive members 23 are fixedly positioned on the first mounting frame 22 and are U-shaped. A plurality of cylindrical member 24 are positioned and equally spaced on the first mounting frame 22. The first electrical plug 20 is sildably positioned on an upper portion of the housing 10 by the first mounting frame 22, and the first pins 21 of the first electrical plug 20 can protrude or retract through the first holes 13. The first electrical plug 20 can conform to conform to US, European, China and Taiwan standards.

The second electrical plug 30 includes two second pins 31, which are made of conductive material and are inserted into a second mounting frame 32. Two second conductive members 33 are fixedly positioned on the second electrical plug 30 and are U-shaped. A plurality of cylindrical member 34 are positioned and equally spaced on the second mounting frame 32. The second electrical plug 30 is sildably positioned on the lower portion of the housing 10 by the second mounting frame 32, and the second pins 31 of the second electrical plug 30 can protrude or retract through the second holes 14. The second electrical plug 30 can conform to US, European, China and Taiwan standards.

The linking mechanism 40 includes a central mount 41 and a spur gear 42, and the central mount 41 is positioned on the housing 10 by snapping. The spur gear 42 is pivotally coupled to the central mount 41 so that the spur gear 42 is free to rotate on the housing 10. The linking mechanism 40 is positioned between the first electrical plug 20 and the second electrical plug 30 so that the spur gear 41 engages with the cylindrical members 24 and 34, respectively. Because the linking mechanism 40 is positioned between the first electrical plug 20 and the second electrical plug 30, there is relative movement between the first electrical plug 20 and the second electrical plug 30. That is, when the first electrical plug 20 protrudes, the second electrical plug 30 retracts by means of the spur gear 42 of the linking mechanism 40. Additionally, when the first electrical plug 20 retracts, the second electrical plug 30 protrudes by means of the spur gear 42 of the linking mechanism 40.

The clamping mechanism 50 includes a sliding plate 51, and a protuberance 52 is provided on and extends from the bottom surface of the sliding plate 52. The sliding plate 51 is sildably positioned within the housing 10, and the protuberance 52 is slidably mounted in the guide groove 15. The protuberance 52 protrudes through the housing 10 so that user can push the protuberance 52 forwards or backwards. Four pins 53 and four sheets 54 are provided at the bottom of the sliding plate 51, and four pins 53 and four sheets 54 are removably mounted in corresponding holes 25 and 26 of the first mounting frame 22 of the first electrical plug 20. Then, the clamping mechanism 50 is coupled to the first electrical plug 20. A user can push the protuberance 52 of the clamping mechanism 50 forwards or backwards so that the first pins 21 of the first electrical plug 20 protrudes through or retract within the housing 10. Meanwhile, with respect to the first electrical plug 20, the second pins 31 of the second electrical plug 30 retract within the housing 10 or moves forward by the linking mechanism 40.

A plurality of resilient members 55 are positioned between the sliding plate 51 of the clamping mechanism 50 and the first mounting frame 22 of the first electrical plug 20. The resilient members 55 bias the sliding plate 51 and the protuberance 52 to their original positions. Three guide grooves 16 are integrally formed in the inner surface of the upper portion of the housing 10, and the three guide grooves 16 are positioned in a front portion, a middle portion and a rear portion of the housing 10. The four sheets 54 of the sliding plate 51 slightly protrude from the sliding plate 51 so that the four sheets 54 are alternately inserted into the guide grooves 16.

When user pushes the protuberance 52, the sliding plate 51 and the four sheets 54 move downwardly so that the four sheets 54 are moved away from the guide grooves 16. Thus, the first electrical plug 20 protrudes through or retracts back into the housing 10 when the protuberance 52 of the clamping mechanism 50 moves forwards or backwards. The linking mechanism 40 pushes the second electrical plug 30 backwards or moves forwards. When the first electrical plug 20 and the second electrical plug 30 protrude through or retract back into the housing 10, the user can release the downward force on the protuberance 52, and the sliding plate 51 and the protuberance 52 move back to their original position due to the resilience of the resilient members 55. Additionally, the four sheets 54 of the sliding plate 51 are inserted into the corresponding guide grooves 16.

The conductive members 60 are made of conductive material and fixedly positioned on the housing 10. One end of the conductive members 60 is connected with a conductive wire 70 by soldering. The other ends of the conductive members 60 are a first contact portion 61 and a second contact portion 62. The first contact portion 61 and the second contact portion 62 are positioned on a front portion of the housing 10 and correspond to the conductive members 23 and the second conductive members 33, respectively.

When the first electrical plug 20 moves forwards, the first conductive members 23 of the first electrical plug 20 are in contact with the first contact portion 61 of the conductive members 60. Thus, the conductive members 60 are electrically connected with the first electrical plug 20 so that electrical power is supplied to the conductive members 60 and the conductive wire 70 by the first electrical plug 20. Meanwhile, the second conductive members 33 of the second electrical plug 30 are not in contact with the second contact portion 62 of the conductive members 60.

Figure 8:
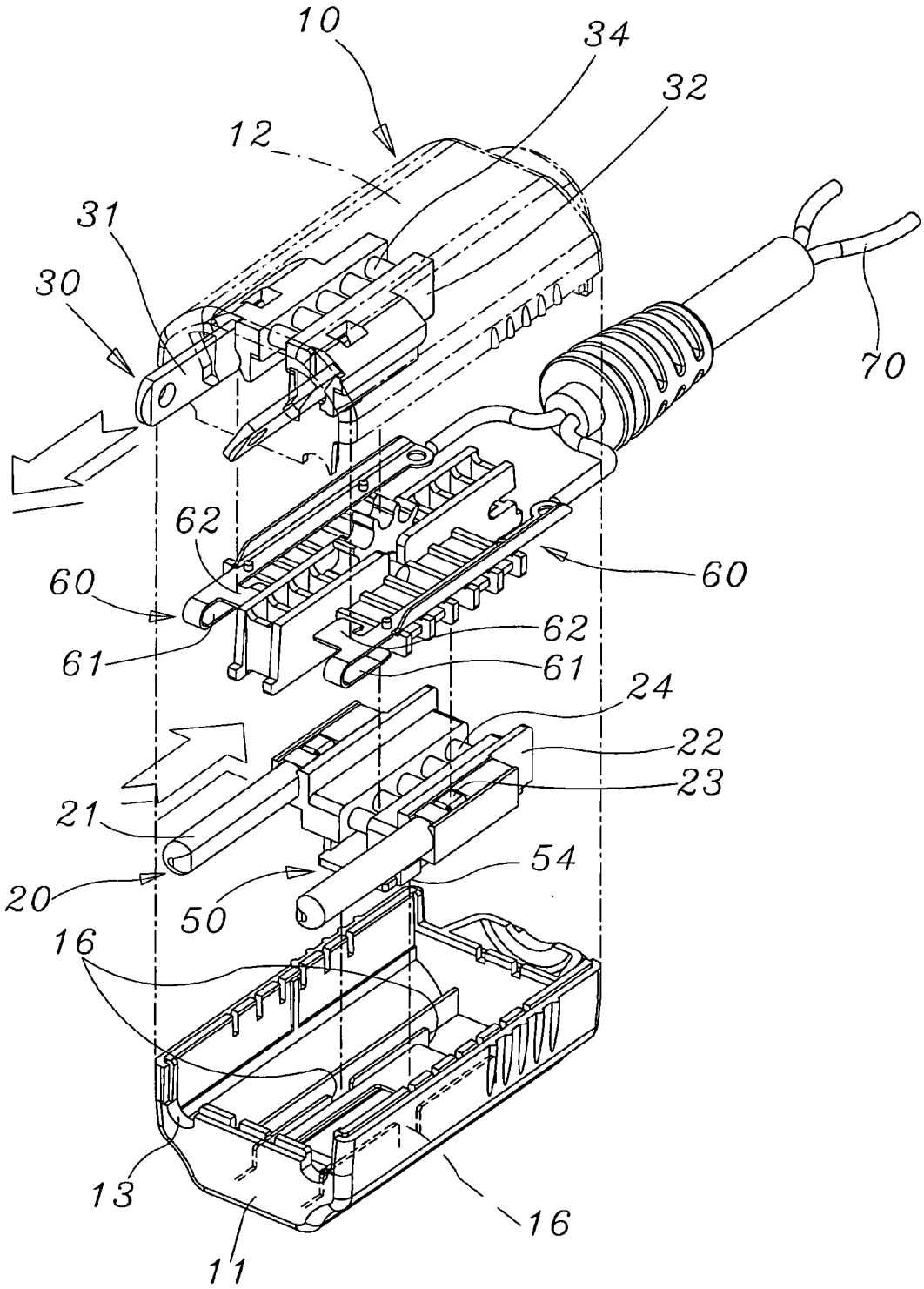
FIG. 8 is a chart illustrating relationship between displacement of a piezoelectric actuator and input signals according to the present invention.

When the second electrical plug 30 moves forwards (as shown in FIG. 8), the second conductive members 33 of the second electrical plug 30 are in contact with the second contact portion 62 of the conductive members 60. Thus, the conductive members 60 are electrically connected with the second electrical plug 30 so that electrical power is supplied to the conductive members 60 and the conductive wire 70 by the second electrical plug 30. Meanwhile, the first conductive members 23 of the first electrical plug 20 are not in contact with the first contact portion 61 of the conductive members 60.

Furthermore, the two first pins 21 of the first electrical plug 20 and the two second pins 31 of the second electrical plug 20 are also electrically connected with the conductive wire 70 (not shown).

According to the present invention, when the user would like to make a transition between the first electrical plug 20 and the second electrical plug 30, relative movement is provided between the first electrical plug 20 and the second electrical plug 30 by means of the linking mechanism 40. That is, if the user moves the first electrical plug 20 forwards or backwards, then the second electrical plug 30 is moved backwards or forwards, accordingly. The present invention provides an easier way to change one kind of electrical plug to the other.

Figure 9:
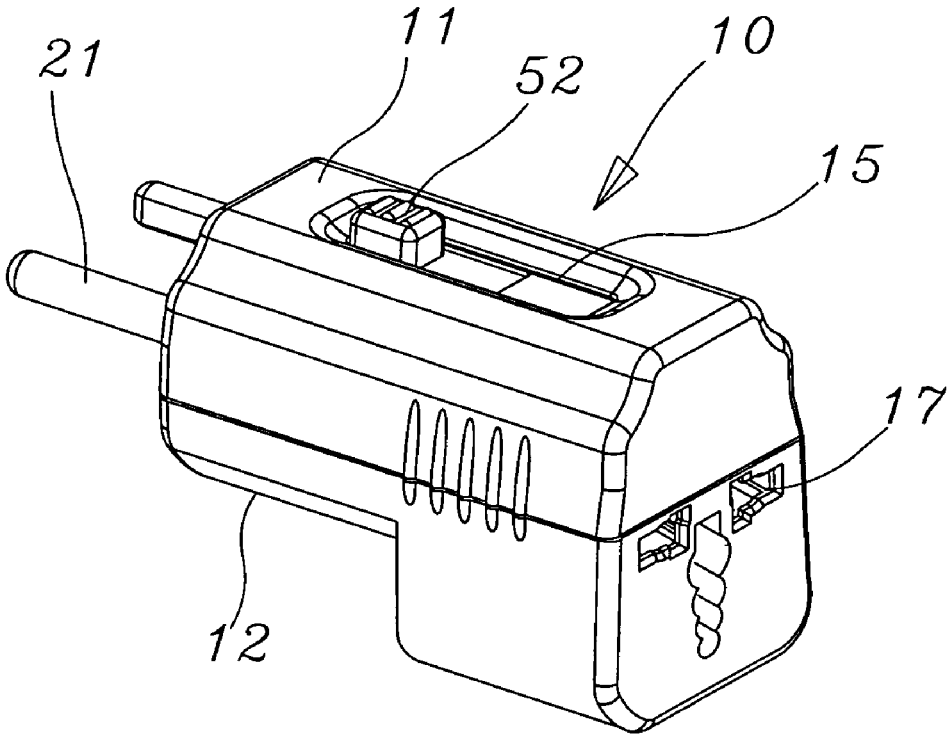
FIG. 9 is a perspective view of an electrical plug changer in accordance with the second embodiment of the present invention.

Referring to FIG. 9, a cable jack 17 can be positioned on the housing 10 of the present invention. The cable jack 17 corresponds to the conductive members 60 within the housing 10 so that the power cable can be electrically connected with the conductive members 60.

Figure 10:
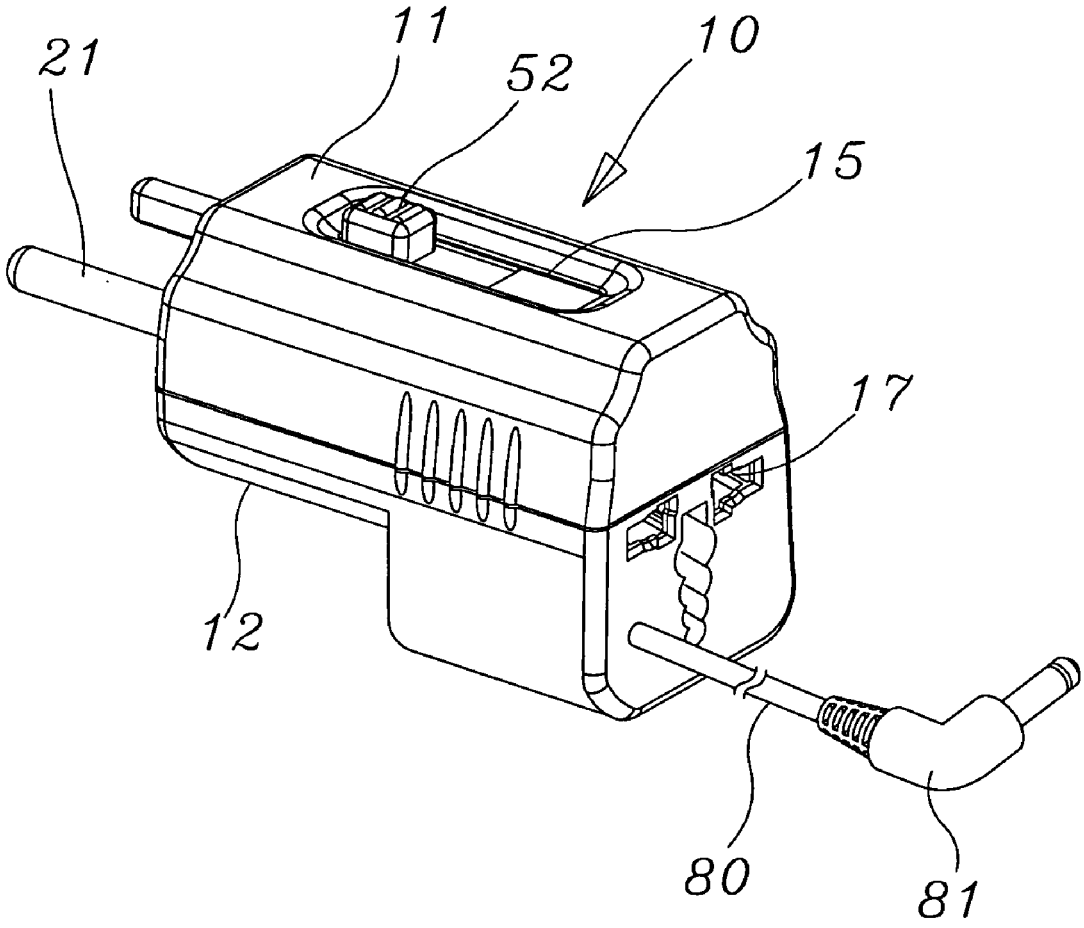
FIG. 10 is a perspective view of an electrical plug changer in accordance with the third embodiment of the present invention.

Referring to FIG. 10, the housing 10 of the present invention may include the cable jack 17 and a conductive wire 80.

Figure 11:
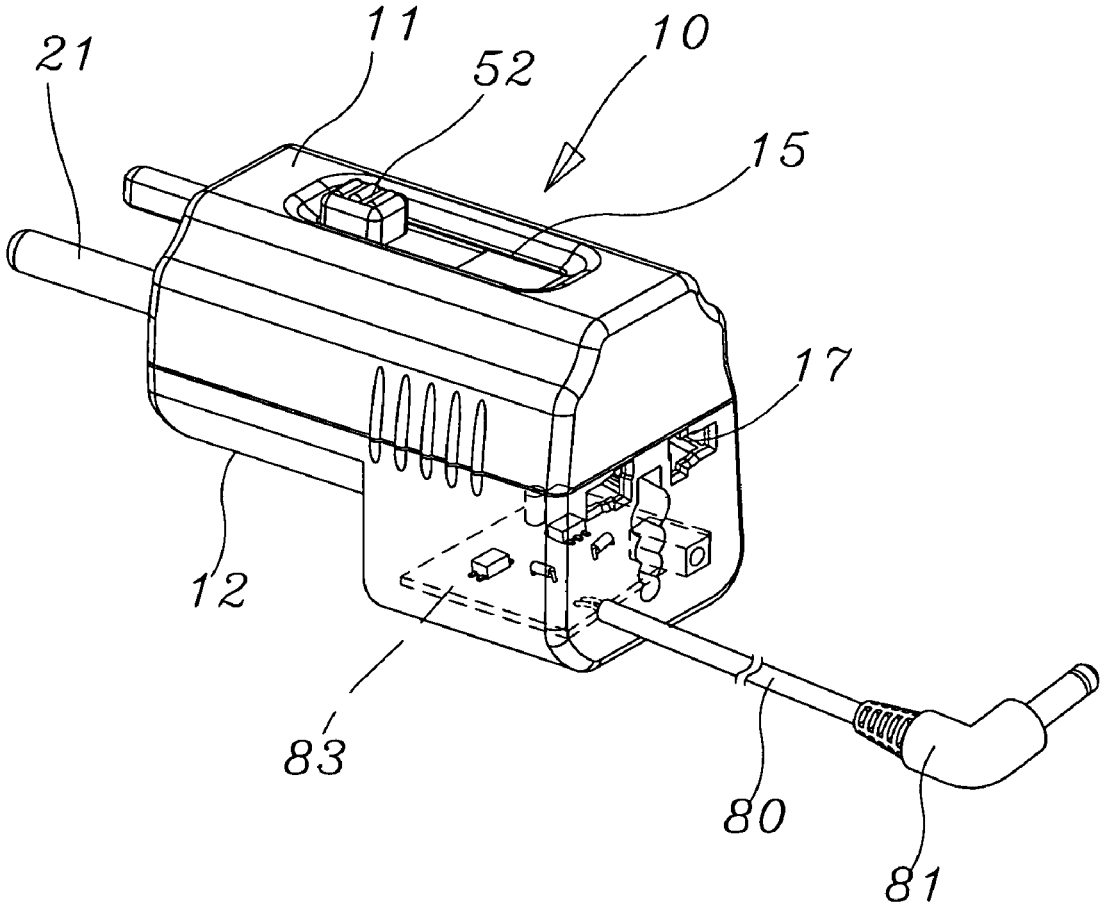
FIG. 11 is a perspective view of an electrical plug changer in accordance with the fourth embodiment of the present invention.
Figure 13:
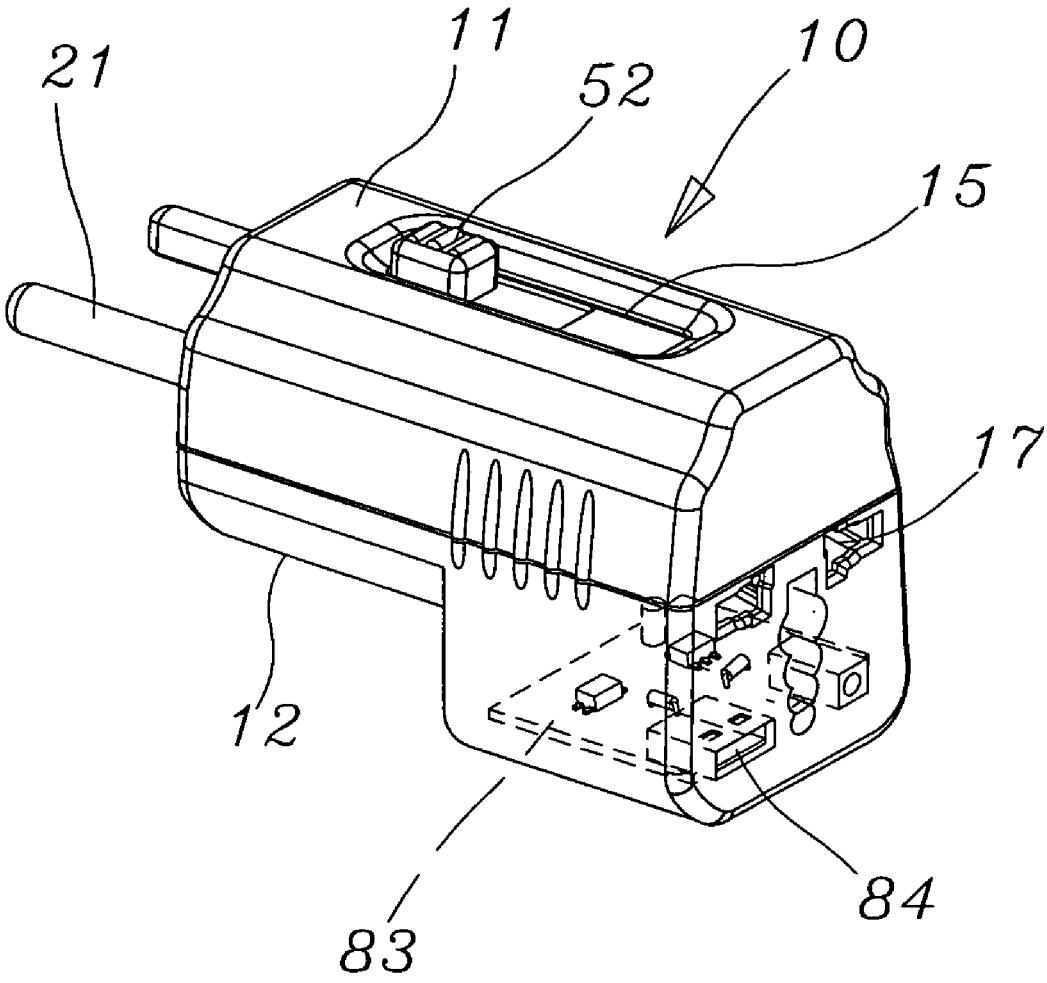
FIG. 13 is a perspective view of an electrical plug changer in accordance with the sixth embodiment of the present invention.

Further referring to FIG. 11, the housing 10 of the present invention further includes rechargeable module 83. The rechargeable module 83 is electrically connected to the first electrical plug 20 and the second electrical plug 30 to provide electrical power to the rechargeable module 83. The rechargeable module 83 is connected to a conductive wire 80, which is connected to a connector 81. The connector 81 can be inserted into a rechargeable cell and can be used as a charger. The rechargeable module 83 is also directly connected to a USB connector 84 (as shown in FIG. 13).

Figure 12:
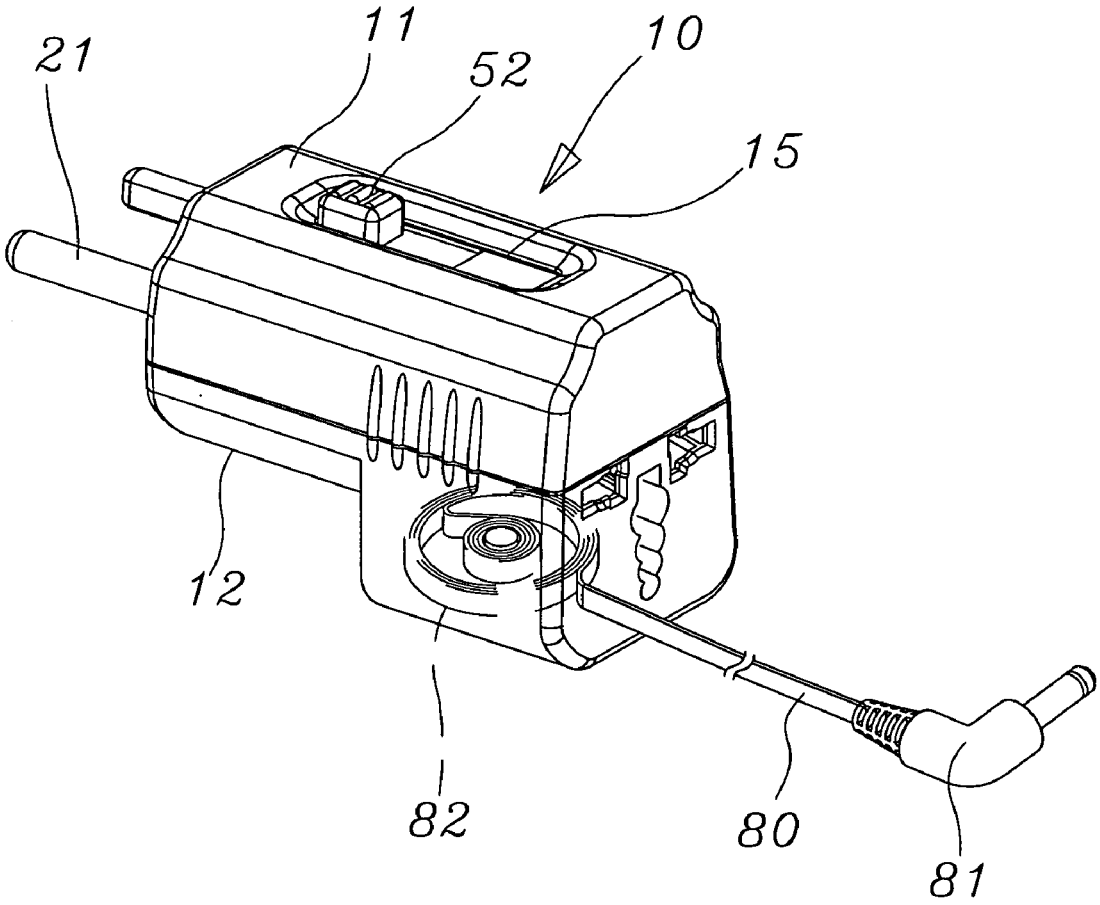
FIG. 12 is a perspective view of an electrical plug changer in accordance with the fifth embodiment of the present invention.

Referring to FIG. 12, the housing 10 of the present invention further includes a spool 82 to store the conductive wire 80.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. An electrical plug changer, comprising:

a housing;

a first electrical plug slidably positioned in an upper portion of the housing, the first electrical plug including two first pins inserted into a first mounting frame and two first conductive members fixedly positioned on the first mounting frame;

a second electrical plug slidably positioned in an lower portion of the housing, the second electrical plug including two second pins inserted into a second mounting frame and two second conductive members fixedly positioned on the second mounting frame;

a pair of third conductive members fixedly positioned in the housing, each of the third conductive members having one end connected with a respective electrical wire, each of the third conductive members having a first contact portion disposed in correspondence with and electrically connected to a respective one of the first conductive members when the first electrical plug is forwardly displaced and a second contact portion disposed in correspondence with and electrically connected to a respective one of the second conductive members when the second electrical plug is forwardly displaced, a linking mechanism positioned between the first electrical plug and the second electrical plug, providing relative movement therebetween; and a clamping mechanism connected to the first electrical plug for displacing the first electrical plug and releasably clamping the first electrical plug at predetermined positions thereof.

2. The electrical plug changer as claimed in claim 1, wherein the housing includes a first cover and a second cover connected together by one of screwing or snapping.

3. The electrical plug changer as claimed in claim 1, wherein the housing has a front surface with a pair of first holes and a pair of second holes formed therein, the first pins of the first electrical plug being respectively protrusible through the first holes and the second pins of the second electrical plug being respectively protrusible through the second holes.

4. An electrical plug changer, comprising:

a housing;

a first electrical plug slidably positioned in an upper portion of the housing, the first electrical plug including two first pins inserted into a first mounting frame;

a second electrical plug slidably positioned in an lower portion of the housing, the second electrical plug including two second pins inserted into a second mounting frame;

a linking mechanism positioned between the first electrical plug and the second electrical plug, providing relative movement therebetween, the linking mechanism including a central mount and a spur gear, the central mount being positioned on the housing, the spur gear being pivotally coupled to the central mount, the first mounting frame having a plurality of first cylindrical members for engagement with the spur gear and the second mounting frame having a plurality of second cylindrical members for engagement with the spur gear; and a clamping mechanism connected to the first electrical plug for displacing the first electrical plug and releasably clamping the first electrical plug at predetermined positions thereof.

5. The electrical plug changer as claimed in claim 4, wherein a cable jack is positioned-on the housing.

6. The electrical plug changer as claimed in claim 4, wherein the housing includes a rechargeable module electrically connected to the first electrical plug and the second electrical plug to provide electrical power to the rechargeable module.

7. The electrical plug changer as claimed in claim 4, wherein the housing includes a rechargeable module electrically connected to the first electrical plug and the second electrical plug, the rechargeable module being connected to a conductive wire.

8. The electrical plug changer as claimed in claim 7, wherein the housing includes a spool to store the conductive wire thereon.

9. An electrical plug changer, comprising:

a housing having a guide opening formed therethrough and a plurality of guide grooves integrally formed in an inner surface of the housing;

a first electrical plug slidably positioned in an upper portion of the housing, the first electrical plug including two first pins inserted into a first mounting frame;

a second electrical plug slidably positioned in an lower portion of the housing, the second electrical plug including two second pins inserted into a second mounting frame;

a linking mechanism positioned between the first electrical plug and the second electrical plug, providing relative movement therebetween; and a clamping mechanism connected to the first electrical plug for displacing the first electrical plug and releasably clamping the first electrical plug at predetermined positions thereof, the clamping mechanism including a sliding plate and a protuberance provided on the sliding plate, the sliding plate being sildably positioned within the housing, the protuberance being slidably mounted in the guide opening, the sliding plate having a plurality of pins and a plurality of sheets provided at a bottom thereof, the plurality of pins and the plurality of sheets being removably mounted in corresponding holes in the first mounting frame of the first electrical plug, a plurality of resilient members being positioned between the sliding plate of the clamping mechanism and the first mounting frame of the first electrical plug, the plurality of sheets of the sliding plate being positionally disposed in correspondence with at least a portion of the plurality of guide grooves.

* * * * *